US005527142A

United States Patent [19]

Chih-Kwo

[11] Patent Number: 5,527,142

[45] Date of Patent: Jun. 18, 1996

[54] PERFORATING AND BINDING MACHINE

[76] Inventor: Ho Chih-Kwo, 2nd Fl., No. 5-1, Lane 163, Hsin I Road, Panchiao, Taiwan

[21] Appl. No.: 431,133

[22] Filed: Apr. 28, 1995

[51] Int. Cl.[6] ..... B42B 5/08

[52] U.S. Cl. ..... 412/38; 412/16

[58] Field of Search ..... 412/10, 16, 33, 412/38, 39, 40; 281/21.1

[56] References Cited

U.S. PATENT DOCUMENTS

| | | | |
|---|---|---|---|
| 4,008,501 | 2/1977 | Cutter | 412/40 X |
| 4,610,590 | 9/1986 | Pigna | 412/38 X |
| 4,872,796 | 10/1989 | Hsieh et al. | 412/40 X |

*Primary Examiner*—Willmon Fridie, Jr.
*Attorney, Agent, or Firm*—Bacon & Thomas

[57] ABSTRACT

An improved perforating and binding machine includes a transmission device provided between a motor and a transmission shaft of a perforating mechanism. The transmission device consists of a swivel arm and a rocker. The swivel arm has one end thereof vertically and fixedly connected to an output shaft of the motor, with the other end thereof vertically projecting to form a slide lever. The rocker has one end thereof vertically and fixedly connected onto the transmission shaft and a slide groove in the middle thereof for insertion of the slide groove therethrough, so that the rocker may reciprocate to cause the perforating mechanism to displace linearly to achieve automatic perforation.

1 Claim, 4 Drawing Sheets

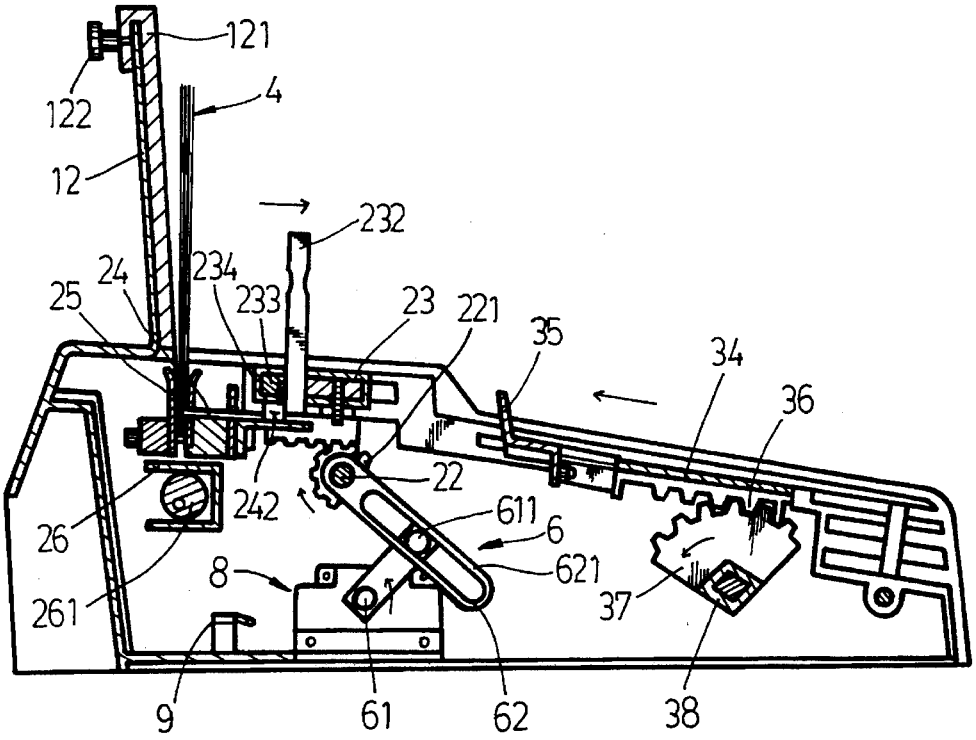
FIG. 5
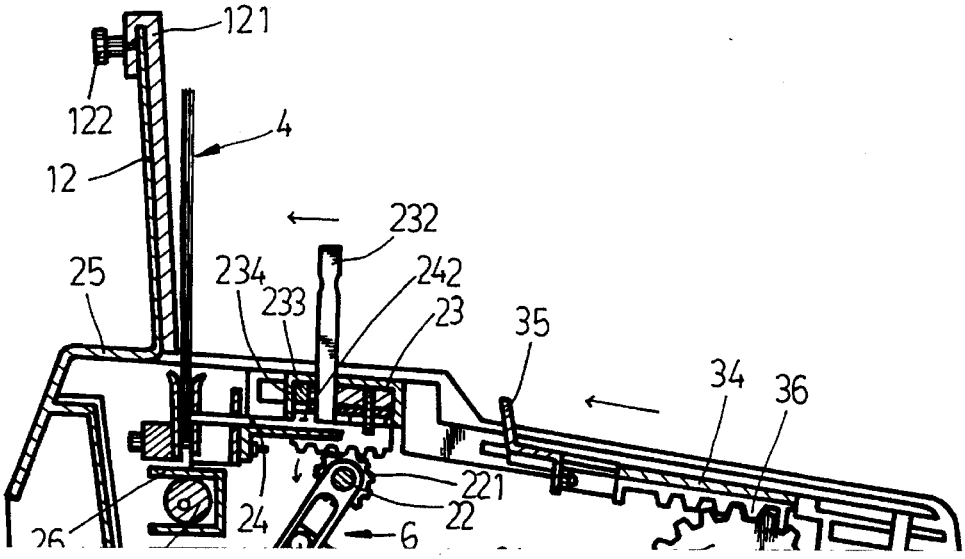

PERFORATING AND BINDING MACHINE

BACKGROUND OF THE INVENTION

1. Field of the Invention

The present invention relates generally to an improved perforating and binding machine, and more particularly to a novel and practical automatic perforating machine.

2. Description of the Prior Art

In the conventional perforating machines, the user has to manipulate the rocker of the perforating machine to reciprocate the machine to cause the perforating cutters to form holes in sheets of paper. Such kinds of machines are not only troublesome but also out-dated and inefficient in the present day society.

SUMMARY OF THE INVENTION

A primary object of the present invention is to provide an improved perforating and binding machine having a transmission device, which is easy and convenient to operate, eliminating the drawbacks in conventional perforating and binding machines.

BRIEF DESCRIPTION OF THE DRAWINGS

The foregoing and other features and advantages of the present invention will be more clearly understood from the following detailed description and the accompanying drawings, in which.

FIG. 5 is a schematic view showing the advancing of the perforating cutters of the present invention;

FIG. 6 is a schematic view of the withdrawal of perforating cutters of the present invention.

DETAILED DESCRIPTION OF THE PREFERRED EMBODIMENT

Figure 1:
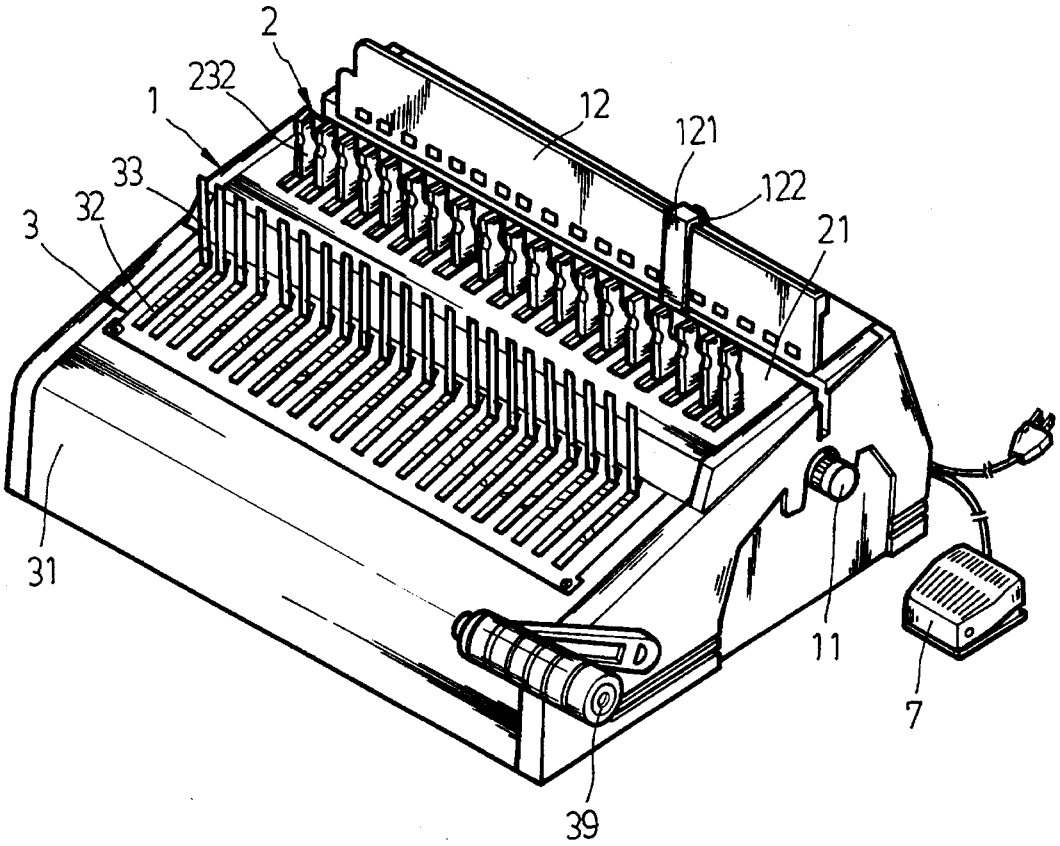
FIG. 1 is a perspective view of the outer look of the present invention.
Figure 2:
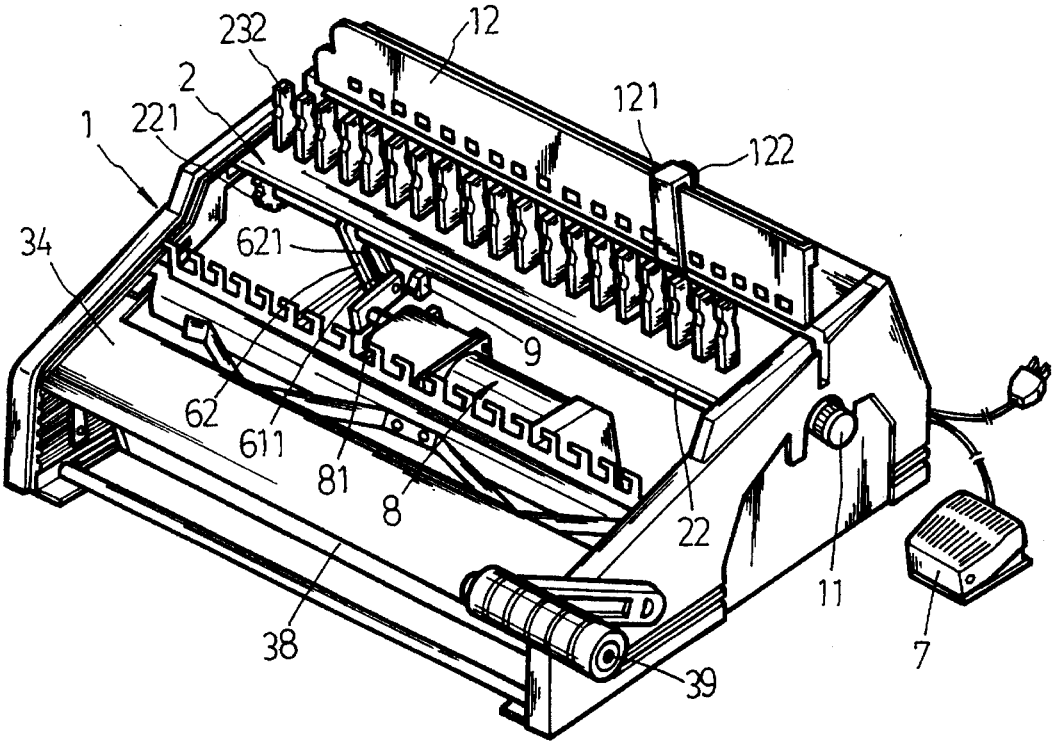
FIG. 2 is a schematic view of the structure of the present invention.
Figure 3:
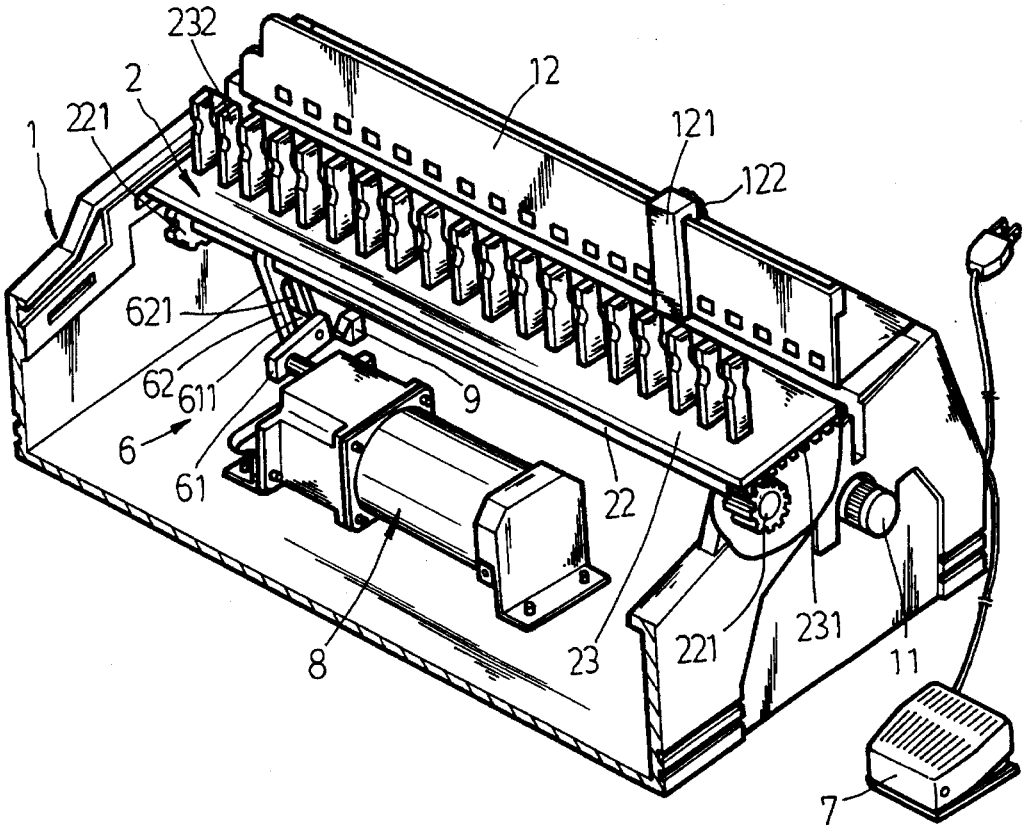
FIG. 3 is a sectional view of the present invention in part.
Figure 4:
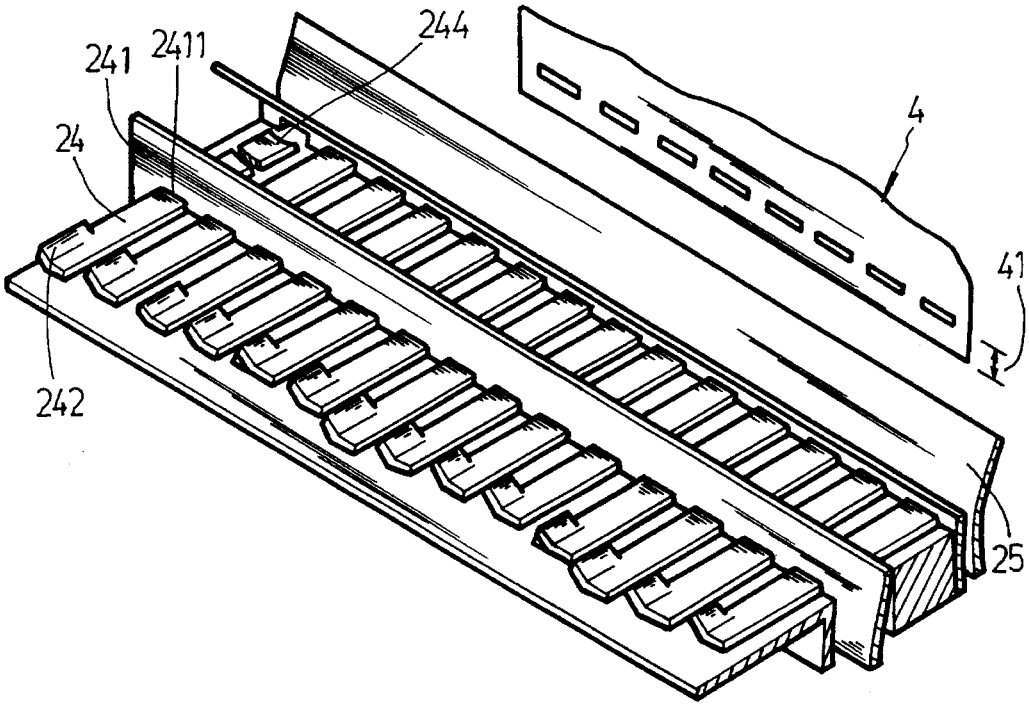
FIG. 4 is a schematic view of the perforating cutters of the present invention.

With reference to FIG. 1, the perforating and binding machine according to the present invention comprises a body 1, a perforating mechanism 2 disposed at a rear end thereof, and a binding mechanism 3 at a front end thereof. As shown in FIGS. 2 to 4, the perforating mechanism 2 consists of a hood 21 at the rear end of the body 1, a transmission shaft 22 is horizontally disposed at either lateral sides thereof at a lower portion. Either ends of the transmission shaft 22 are provided with a link-up gear 221 for engaging with a rack 231 of an advancing seat 23. A plurality of perpendicular control levers 232 are provided on the advancing seat 23 for pressing against corresponding perforating cutters 24 which are caused to slidably advance in the direction of a sheet of paper 4 to form holes therein. The control levers 232 may be pulled up and secured by elastic rubber strips 233 (see FIG. 5) disposed within the advancing seat 23 and pressing thereagainst, so that the control levers 232 will not drop down and will not be unable to press against the perforating cutters 24 to cause them to advance. The control levers 232 may be used to adjust the number of perforations in the sheets of paper.

As shown in FIGS. 3 and 4, the perforating cutters 24 are arranged in a horizontal manner and positioned in corresponding notches 2411 at a lower portion of a securing piece 241. The rear portions of the perforating cutters 24 form lateral bent portions 242. The front portions thereof are provided with curved blades 244. By means of the arrangement of the bent portions 242, after perforation is completed, a support piece 234 (see FIG. 5) at a front end of the advancing seat 23 hooks against the bent portions 242 to the left so that the perforating cutters 24 may displace rearwardly with the advancing seat 23 to return to their original positions. Additionally, the perforating cutters 24 are of different lengths so as to reduce the concentration during perforation, making the perforating operation easier.

With reference to FIGS. 4, 5 and 6, the sheet of paper 4 is placed inside a paper holder 25 at the rear end of the perforating cutters 24. A support element 26 with a biased shaft 261 fitted inside is provided at the lower part of the paper holder 25. As shown in FIG. 1, the right side of the body 1 is provided with a knob 11 which is connected onto the biased shaft 261. By turning the knob 11, the biased shaft 261 may be caused to bias and to adjust the up and down movements of the support element 26 so as to control the distance from the perforations 42 to the edge of the sheet of paper 4. A movable adjusting plate 121 may also be provided on a baffle 12 to reciprocate thereon, and they are secured together by means of a screw 122 at the rear side.

Figure 7:
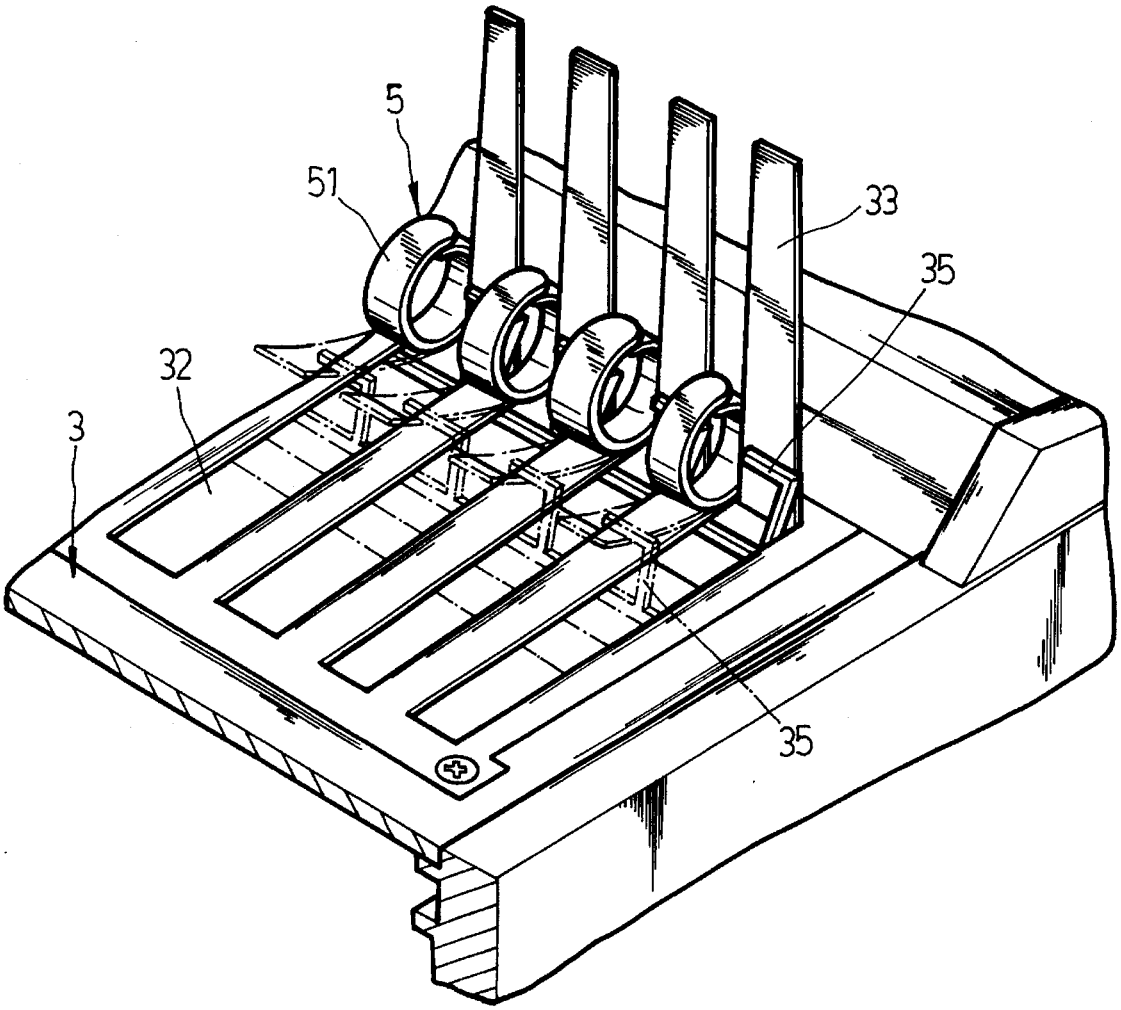
FIG. 7 is a schematic view of the present invention, showing the trigger levers and the binding clips of the present invention.

As shown in FIGS. 1, 2, 5 and 6, the binding mechanism 3 is disposed at a front end of the body 1 and is covered by a housing 31. The housing 31 consists of a plurality of rectangular notches 32 in the upper side of the housing 31 at suitable positions. A plurality of securing pieces 33 extend perpendicularly upward from the front end. A slide plate 34 is horizontally disposed therein. One side of the slide plate 34 is connected to trigger levers 35 which are equally spaced apart and project into the rectangular grooves perpendicularly. A rack 36 is provided at the bottom side of the binding mechanism 3 for engaging the transmission shaft 38 of a fan-shaped gear wheel 37 with two ends. One end of the transmission shaft 38 is connected to a control grip lever 39, whereby a clip piece 51 of each binding ring 5 may be pulled open with the rearward displacement of the trigger lever 35, so that loose-leaf sheets may be fitted on the binding rings 5 to be bound into a book (as shown in FIG. 7).

The features of the present invention reside in that a transmission device 6 and a motor 8 are disposed within the body 1. The transmission device 6 consists of a swivel arm 61 and a rocker 62. One end of the swivel arm 61 is perpendicularly and fixedly secured to an output shaft 81 of the motor 8. The other end thereof perpendicularly extends to form a slide lever 611. The rocker 62 has one end thereof perpendicularly and fixedly connected onto the transmission shaft 22. The rocker 62 further has a slide groove 621 in the middle thereof for insertion of the slide lever 611 therethrough so that, by means of the turning of the swivel arm 61, the rocker 62 is caused to perform linear reciprocating movements, achieving the object of synchronously actuating the perforating mechanism 2.

The operation of the invention will now be described with reference to FIGS. 5 and 6. The motor 8 of the invention is actuated by pressing a pedal control device 7. Then the swivel arm 61 may turn therewith. With the slide lever 611 of the swivel arm 61 slidably displacing within the slide groove 621 of the rocker 62, the rocker 62 is caused to linearly reciprocate so that the transmission shaft 22 is actuated. And by means of the gear 221 of the transmission shaft 22 which drives the rack 231 of the advancing seat 23, the advancing seat 23 may also linearly reciprocate to slidably displace on both sides of the body 1, so that a sheet of paper 4 on the paper holder 25 may be perforated by the perforating cutters 24 (see FIG. 4). Such automatic perforating procedures are time-saving and simple to perform, and hence the perforating and binding machine of the present invention is very practical.

Furthermore, a contact switch 9 may be further provided in the body 1 at a limiting position behind the rocker 62 such that when the rocker 62 swings rearward to the limiting position (the advancing seat 23 and the perforating cutters 24 being in their original positions), an extreme end of the rocker 62 touches the contact switch 9 to disconnect the electricity, thus completing one cycle of advancing and withdrawal of the perforating cutters 24. To actuate the machine of the present invention again, it is only necessary to press the pedal control device 7 to start the cycle all over again.

In view of the aforesaid, according to the present invention, the crankshaft turning movement of the transmission device 6 is converted to the linear reciprocating movement of the perforating mechanism so that the present invention not only provides smooth operation in practical use but also has the advantages of safe and simple operation in terms of effects.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved perforating and binding machine, comprising:

a base;

a perforating seat having a transmission shaft at a bottom side thereof to enable said perforating seat to linearly reciprocate on both sides of said base;

a paper holder for receiving sheets of paper to facilitate perforation of the sheets by means of a plurality of perforating cutters of said perforating seat;

a binding seat for binding perforated sheets of paper; a transmission device provided between a motor and said transmission shaft, and a control device for actuating the motor; wherein said transmission device consists of a swivel arm and a rocker, one end of said swivel arm being perpendicularly and fixedly connected to an output shaft of the motor, while the other end thereof perpendicularly projecting to form a slide lever, and said rocker having one end thereof perpendicularly and fixedly connected onto said transmission shaft to be disposed and having a slide groove in the middle thereof for insertion of said slide lever therethrough so that said swivel arm enables said rocker to reciprocate to synchronously actuate said perforating seat.

* * * * *